US005192135A

United States Patent [19]

Woods et al.

[11] Patent Number: 5,192,135

[45] Date of Patent: Mar. 9, 1993

[54] PROFILE AND ADJACENT RIB-TYPE CLOSURE ELEMENT FOR RECLOSABLE THERMOPLASTIC BAGS

[75] Inventors: Jamie M. Woods, Kawkawlin; Jose Porchia; Brian C. Dais, both of Midland, all of Mich.

[73] Assignee: Dowbrands L.P., Indianapolis, Ind.

[21] Appl. No.: 708,411

[22] Filed: May 31, 1991

[51] Int. Cl.[5] ..... B65D 33/24

[52] U.S. Cl. ..... 383/63; 24/577; 24/587

[58] Field of Search ..... 383/63, 64, 65; 24/587, 24/577, 399, 400

[56] References Cited

U.S. PATENT DOCUMENTS

| | | | |
|---|---|---|---|
| 3,416,199 | 12/1968 | Imamura | 383/63 X |
| 4,484,352 | 11/1984 | Katzin | 383/65 |
| 4,672,723 | 6/1987 | Hugues et al. | 383/65 X |
| 4,736,496 | 4/1988 | Fisher et al. | 383/63 X |
| 4,741,789 | 5/1988 | Zieke et al. | 383/65 X |
| 4,854,017 | 8/1989 | Kamp | 383/63 X |
| 4,907,321 | 3/1990 | Williams | 383/63 X |
| 5,012,561 | 5/1991 | Porchia et al. | 383/63 X |

*Primary Examiner*—Allan N. Shoap
*Assistant Examiner*—Jes F. Pascua

[57] ABSTRACT

A closure member for a reclosable plastic bag, including a longitudinally-extending profile interlockable with an opposing longitudinally-extending profile of a second closure member, and a pair of longitudinally-extending ribs located adjacent and generally parallel to the profile on either side of the profile, with the ribs each being characterized in cross-section by a lower generallly triangularly-shaped portion and by an upper bulbous portion defined generally at an apex of the lower generally triangularly shaped portion.

7 Claims, 1 Drawing Sheet

PROFILE AND ADJACENT RIB-TYPE CLOSURE ELEMENT FOR RECLOSABLE THERMOPLASTIC BAGS

BACKGROUND OF THE INVENTION

The present invention relates to reclosable plastic bags and to the closures employed on such bags. More particularly, the invention relates to the variety of closure employing interlocking longitudinally-extending male and female rib- and groove-type profiles wherein the male profile is flanked on either side by a pair of ribs.

In this particular variety of closure, a first rib member is disposed on one side of the male rib-type profile, and a second rib member is disposed on the other side of the male profile. Both the first and second rib members are designed to extend in a generally parallel, spaced relation to the male profile over the width of the bag's opening. The rib members are added to stiffen the area of the bag film around the male profile and to thereby help the user to align and engage the male and female profiles. Additionally, the ribs are believed to better distribute the closing force exerted by the user over a greater area of the bag film, thus making the user feel as though the male and female profiles are easier to engage.

Closures of the type described in the preceding paragraph are made integrally with the extrusion of the underlying bag film web, or the bag film web can be formed separately and the elements of the closure later formed and applied to the bag film web.

The ribs which have been employed to date with rib- and groove-type closures have conventionally been triangular in shape, although ribs having a circular cross-section are suggested in the context of a particular method of making the bag film web and closure elements separately, see U.S. Pat. No. 4,741,789 to Zieke et al., col. 6, lines 43–52.

One problem experienced on occasion with conventional triangular ribs is that for thin bag film webs and small closure elements and ribs and/or for ribs made from low melt index materials, the ribs tend to fracture and become discontinuous along their length as they are drawn down onto a casting roll, for example. This problem diminishes the effectiveness of the ribs in peforming the functions for which they were intended.

SUMMARY OF THE INVENTION

The present invention solves this problem, and realizes certain other benefits to be described subsequently, by providing a profile and adjacent rib-type closure element having a modified cross-section for the ribs. In this modified cross-section, the ribs have a conventional generally triangular base which is surmounted by a bulbous portion. The bulbous portion provides additional polymer at the tip of a rib which can be employed in keeping the rib continuous over its length. Fracturing is prevented on additional processing, while still enabling the manufacture of closure elements of the desired size and of the desired materials.

DETAILED DESCRIPTION OF THE PREFERRED EMBODIMENTS

Figure 1:
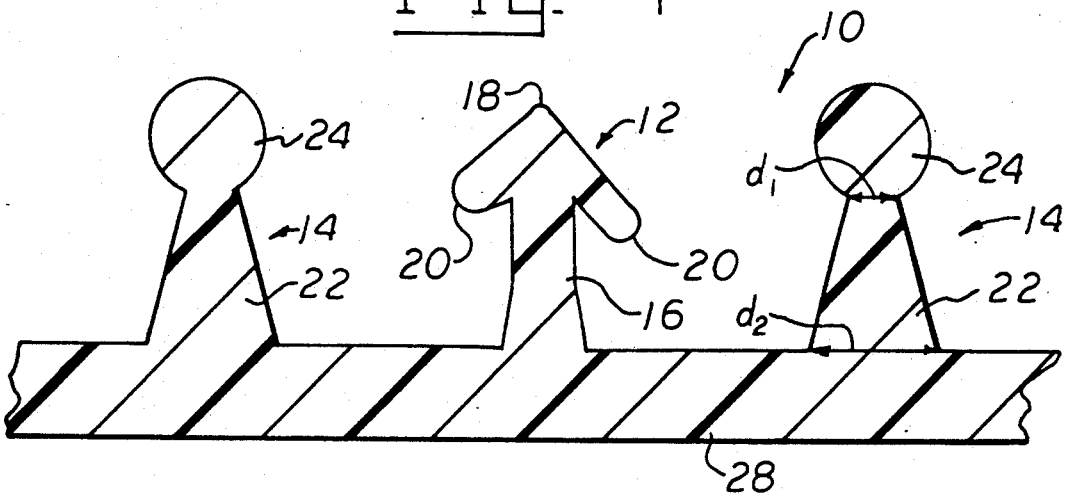
FIG. 1 is a cross-sectional view of a preferred embodiment of the modified profile and adjacent rib-type closure element of the present invention.

Referring now to the drawings, and more particularly to FIG. 1, a preferred embodiment of the modified profile and adjacent rib-type closure of the present invention is illustrated.

The modified profile and adjacent rib-type closure 10 in FIG. 1 comprises a conventional longitudinally extending male rib-type profile 12 and adjacent longitudinally extending ribs 14. The male rib-type profile 12 comprises a stem 16 and a generally arrowhead-shaped head 18, with the head 18 defining hooks 20 for interlocking with the hooks of a corresponding female groove-type profile (not shown) in a conventional manner.

The ribs 14 have a modified cross-section in accordance with the present invention, and comprise a lower generally triangularly-shaped portion 22 with an upper bulbous portion 24 defined generally at an apex of the triangularly-shaped portion 22. In the embodiment of FIG. 1, the bulbous portion is generally circular in cross-section so that the center of the bulbous portion 24 is placed generally along the centerline of the lower triangularly-shaped portion 22, with the lower portion 22 in turn having the form generally of an isosceles triangle. The axis or centerline of the portion 22 essentially parallels the corresponding axis or centerline of the profile 12. The resulting ribs 14 have the appearance of a keyhole, and can be thought of in other terms as resulting from the superimposition of a circle on an isosceles triangle at an apex thereof or along the centerline thereof.

The embodiment of FIG. 1 can be made simply by drilling in a profile plate of a conventional profile and adjacent rib-type closure element a hole of a selected radius from the apex of each triangularly-shaped rib or from a point generally along the center line of such rib.

The bulbous portion 24 as previously noted is designed to place greater amounts of polymer at the end or tip of a rib 14, and to prevent fracturing of the type described above by virtue of the added polymer. In designing the ribs 14, however, to accomplish this end, there are several items to consider.

One such item concerns the width of the actual profile plate opening (not shown) for producing the ribs 14 at the locations suggested by $d_1$ and $d_2$ in FIG. 1. The width of the profile plate opening corresponding to the intersection of the lower triangular portion 22 and bulbous portion 24 of a rib 14 is to be understood as being given by $d_1$, while the width of the actual profile plate at the base of the lower portion 22 is understood as being given by $d_2$.

If the profile plate is cut so that $d_1$ is made too small relative to $d_2$, then polymer for the ribs 14 tends not to flow into the part of the profile plate corresponding to the bulbous portion 24. The resulting rib may have a more conventional generally triangularly-shaped cross-section, or the upper bulbous portion 24 may be too small to prevent fracturing over the entire length of the rib 14 and to achieve a secondary sealing benefit to be described in greater detail below.

If $d_1$ is on the other hand made too large relative to $d_2$, then the bulbous portion 24 can become too large relative to the lower portion 22 supporting it. This also is an undesirable result, for reasons which will be explained subsequently. The proper dimensions $d_1$ and $d_2$ in the profile plate opening for a rib 14 will achieve for a particular material of manufacture a suitably but not overly augmented tip of a rib 14.

Figure 2:
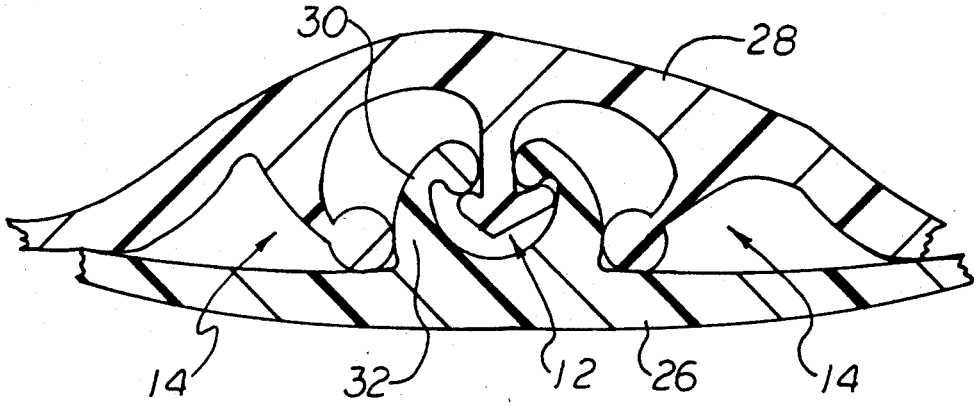
FIG. 2 is a fragmentary cross-sectional view in the area of the end of the closure of a reclosable plastic bag made with the closure element of FIG. 1.
Figure 3:
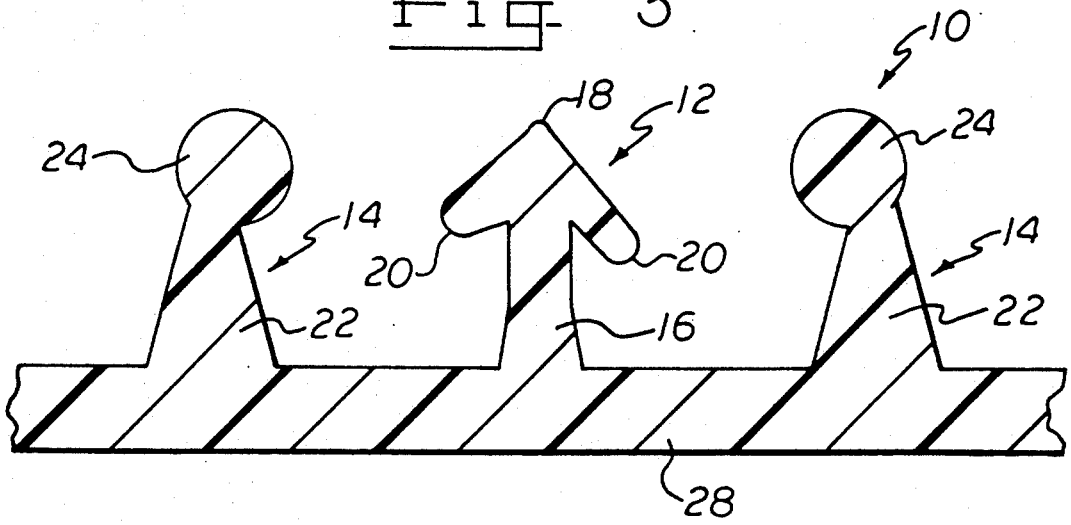
FIG. 3 is a cross-sectional view of an alternate, more preferred embodiment of the closure element of the present invention.

As a second consideration, it is also important in moving from a conventional male closure element to the type of closure element shown in FIGS. 1–3 that the modified ribs 14 and profile 12 be sized so that the ribs 14 do not fill or are not formed preferentially in the profile plate over the profile 12, and vice-versa. Some experimentation may be required in this regard for different configurations and resins, so that the ribs 14 preferably are made only slightly taller than the profile 12 and so that the ribs 14 and profile 12 may generally fulfill their customary roles in the closure of a bag. This experimentation is well within the abilities of one versed in the art of making the conventional profile and adjacent rib-type closure elements, however, and essentially involves a balancing of the pressure drops involved in filling out or forming the ribs 14 and profile 12 through a profile plate.

A second benefit of the modified construction of the ribs 14 of the present invention has already been alluded to and is illustrated in FIG. 2, in that the modified ribs 14 can act as a secondary sealing mechanism against leaks through the end of the closure of a bag in which the modified ribs 14 are employed.

Referring now to FIG. 2, opposed sidewall portions 26 and 28 of the bag carry a female groove-type profile 30 and the modified male closure element 10, respectively. As the male and female profiles 12 and 30 are interlocked and the sidewall portions 26 and 28 clamped or pressed together for sealing, the bulbous portions 24 of the ribs 14 contact the sidewall portion 26. The portions 24 as a result of this contact are preferably urged toward the base 32 of the female profile 30 and toward something of an interlocking engagement with the base 32 of the female profile 30, such that materials must circumvent the portions 24 as well as the interlocking engagement of the male and female profiles 12 and 30 to move through the sideweld from the interior of the bag to its exterior.

In practical terms, the presence of the bulbous portions 24 at the ends or tips of ribs 14 helps to fill and to restrict the space defined between the ribs of one closure element and a second closure element through which leaking materials might otherwise travel.

The likelihood of the bulbous portions 24 of the ribs 14 being urged inwardly toward the base 32 of the female profile 30, rather than outwardly and away from the base 32, is believed to be at least in part a function of the method employed for creating a side-weld between the sidewall portions 26 and 28. Where grooves are provided on clamping members for receiving the male element 10 in the manner and in the hot-wire sealing methods described in commonly-assigned U.S. Pat. No. 5,012,561, for example, it is thought that generally both of the bulbous portions 24 will be urged inwardly as in FIG. 2. Where hot-knife sealing rather than hot-wire sealing is employed, however, usually one of the bulbous portions 24 will be pushed inwardly as intended, while the other portion 24 is as likely to be urged outwardly away from the female profile 30 as inwardly.

For this reason, and particularly where hot-knife sealing is to be employed, the embodiment of the modified male closure element 10 which is depicted in FIG. 3 is generally more preferred. In this more preferred embodiment, the bulbous portions 24 are encouraged or predisposed to turn inwardly toward the base 32 of the female profile 30 responsive to contact with the sidewall portion 26 rather than away from the base 32 of the profile 30.

In FIG. 3, the bulbous portions 24 atop the generally triangularly-shaped lower portions 22 can be considered generally circular in cross-section, but are displaced inwardly toward the male profile 12 so that their center lies on the inward side of the centerline of the lower triangularly-shaped portions 22 of ribs 14. The ribs 14 in this embodiment can be envisioned as resulting again from the superimposition of a circle on an isosceles triangle, but in this embodiment the circle is centered on the inward side of the centerline of the triangle as opposed to along the centerline generally or at the apex of the triangle. Displacing the bulbous portions 24 of ribs 14 in this fashion, it will be seen, encourages the portions 24 to continue to turn inwardly toward the base 32 of the female profile 30 when compressed against the sidewall portion 26.

To make this sort of predisposition effective, an adequate width $d_1$ must be provided of the triangularly shaped lower portion 22 of a rib 14 at the commencement of the bulbous portion 24. The reader of skill in this respect will understand that if the portion 22 is too flimsy immediately adjacent the portion 24, then when the portion 24 contacts the sidewall 26 the portion 24 may be diverted away from rather than toward the base 32 of the profile 30, notwithstanding any predisposition to the contrary resulting from offsetting the portion 24 inwardly toward the rib profile 12. And where the ribs 14 are constructed according to FIG. 1, if the lower portion 22 is too narrow at its intersection with the bulbous portion 24, then the response of the ribs 14 on sealing by any method may not be predictable or controllable for achieving the secondary sealing characteristics described in the preceding paragraphs.

While preferred embodiments of the modified profile and adjacent rib-type closure members of the present invention have been described herein, it will be appreciated that the principle of the present invention may be applied with similar advantage to other embodiments of profile and adjacent rib-type closure members, as well as to other types of closure members generally without departing in scope or spirit from the present invention.

For example, the concept of adding a bulbous upper portion to a conventional triangularly-shaped rib structure may be applied to other rib structures of a more general tapering quality wherein fracturing is of concern or where a secondary sealing capacity might be obtained by such a modification. Similarly, some commercially available reclosable plastic bags, such as those currently sold by Reynolds Metals Company under its "Sure-Seal" mark, include within a closure element members of a generally triangular or generally tapering quality which could also be modified in the manner suggested herein for ribs.

What is claimed is:

1. A closure member for a reclosable plastic bag, comprising:

a longitudinally-extending profile interlockable with an opposing longitudinally-extending profile of a second closure member; and a longitudinally-extending rib located adjacent and generally parallel to the profile, the rib being characterized in cross-section by a lower generally triangularly-shaped portion and by an upper bulbous portion defined generally at an apex of the lower generally triangularly shaped portion said bulbous portion providing an amount of polymer at said apex sufficient to prevent the fracturing of said rib and to maintain the rib continuous over its length upon forming the rib; and said bulbous portion of the rib adopted to turning inwardly toward the base of the opposing longitudinally-extending profile of a second closure member responsive to contact with a sidewall portion of the bag upon interlocking engagement of the longitudinally-extending profile with the opposing longitudinally-extending profile of a second closure member.

2. A closure member as defined in claim 1, further comprising a second longitudinally-extending rib located adjacent and generally parallel to the profile on a side of the profile which is opposite the first rib, said second rib also being characterized in cross-section by a lower generally triangularly-shaped portion and by an upper bulbous portion defined generally at an apex of the lower generally triangularly shaped portion said bulbous portion providing an amount of polymer at said apex sufficient to prevent the fracturing of said second rib and to maintain the second rib continuous over its length upon forming the second rib; and said bulbous portion of the second rib adopted to turning inwardly toward the base of the opposing longitudinally-extending profile of a second closure member responsive to contact with a sidewall portion of the bag upon interlocking engagement of the longitudinally-extending profile with the opposing longitudinally-extending profile of a second closure member.

3. A closure member for a reclosable plastic bag, comprising:

a longitudinally-extending profile interlockable with an opposing longitudinally-extending profile of a second closure member; and a longitudinally-extending rib located adjacent and generally parallel to the profile, the rib being characterized in cross-section by a lower generally triangularly-shaped portion and by an upper bulbous portion defined generally at an apex of the lower generally triangularly shaped portion, wherein the lower generally triangularly shaped portion and the upper bulbous portion of the rib give the appearance generally of an isosceles triangle having a circle superimposed upon the triangle and centered along the centerline of the triangle.

4. A closure member for a reclosable plastic bag, comprising:

a longitudinally-extending profile interlockable with an opposing longitudinally-extending profile of a second closure member; and a longitudinally-extending rib located adjacent and generally parallel to the profile, the rib being characterized in cross-section by a lower generally triangularly-shaped portion and by an upper bulbous portion defined generally at an apex of the lower generally triangularly shaped portion, wherein the lower generally triangularly-shaped portion and the upper bulbous portion of the rib give the appearance generally of an isosceles triangle having a circle superimposed upon the triangle, with the circle being centered inwardly of the centerline of the triangle and offset toward the profile.

5. A closure member for a reclosable plastic bag, comprising:

a longitudinally-extending profile interlockable with an opposing longitudinally-extending profile of a second closure member;

a first longitudinally-extending rib located adjacent and generally parallel to the profile, the first rib being characterized in cross-section by a lower generally triangularly-shaped portion and by an upper bulbous portion defined generally at an apex of the lower generally triangularly shaped portion; and a second longitudinally-extending rib located adjacent and generally parallel to the profile on a side of the profile which is opposite the first rib, said second rib also being characterized in cross-section by a lower generally triangularly-shaped portion and by an upper bulbous portion defined generally at an apex of the lower generally triangularly shaped portion, wherein the lower generally triangularly-shaped portions and the upper bulbous portions of each of the first and second ribs give the appearance generally of an isosceles triangle having a circle superimposed upon the triangle and centered along the centerline of the triangle.

6. A closure member as for a reclosable plastic bag, comprising:

a longitudinally-extending profile interlockable with an opposing longitudinally-extending profile of a second closure member;

a first longitudinally-extending rib located adjacent and generally parallel to the profile, the first rib being characterized in cross-section by a lower generally triangularly-shaped portion and by an upper bulbous portion defined generally at an apex of the lower generally triangularly shaped portion; and a second longitudinally-extending rib located adjacent and generally parallel to the profile on a side of the profile which is opposite the first rib, said second rib also being characterized in cross-section by a lower generally triangularly-shaped portion and by an upper bulbous portion defined generally at an apex of the lower generally triangularly shaped portion, wherein the lower generally triangularly-shaped portions and the upper bulbous portions of each of the first and second ribs give the appearance generally of an isosceles triangle having a circle superimposed upon the triangle, with the circle being centered inwardly of the centerline of the triangle and offset toward the profile.

7. A reclosable plastic bag comprising a closure member as defined in claims 1, 2, 3, 4, 5 or 6.

* * * * *